US007695290B2

(12) United States Patent
Nakano et al.

(10) Patent No.: US 7,695,290 B2
(45) Date of Patent: Apr. 13, 2010

(54) BOARD CONNECTOR

(75) Inventors: Hiroshi Nakano, Yokkaichi (JP); Masahide Hio, Yokkaichi (JP); Kenji Okamura, Yokkaichi (JP); Hiroki Hirai, Yokkaichi (JP); Hiroomi Hiramitsu, Yokkaichi (JP); Osamu Hirabayashi, Yokkaichi (JP)

(73) Assignees: AutoNetworks Technologies, Ltd. (JP); Sumitomo Wiring Systems, Ltd. (JP); Sumitomo Electronic Industries, Ltd. (JP)

( * ) Notice: Subject to any disclaimer, the term of this patent is extended or adjusted under 35 U.S.C. 154(b) by 229 days.

(21) Appl. No.: 11/887,790

(22) PCT Filed: Apr. 21, 2006

(86) PCT No.: PCT/JP2006/308455

§ 371 (c)(1),
(2), (4) Date: Oct. 3, 2007

(87) PCT Pub. No.: WO2006/115218

PCT Pub. Date: Nov. 2, 2006

(65) Prior Publication Data

US 2009/0029574 A1 Jan. 29, 2009

(30) Foreign Application Priority Data

Apr. 22, 2005 (JP) ..... 2005-125416

(51) Int. Cl.
*H01R 12/00* (2006.01)

(52) U.S. Cl. ..... 439/83; 439/485

(58) Field of Classification Search ..... 439/79, 439/83, 485, 205, 206
See application file for complete search history.

(56) References Cited

U.S. PATENT DOCUMENTS

| | | | | |
|---|---|---|---|---|
| 4,660,911 | A * | 4/1987 | Reynolds et al. | 439/83 |
| 2001/0015897 | A1 | 8/2001 | Aida et al. | |
| 2003/0082945 | A1 | 5/2003 | Belady et al. | |
| 2005/0158687 | A1 * | 7/2005 | Dahm | 433/29 |

FOREIGN PATENT DOCUMENTS

| | | |
|---|---|---|
| JP | 5-41076 | 6/1993 |
| JP | 61-60486 | 6/1994 |
| JP | 8-148239 | 6/1996 |
| JP | 2001-291410 | 10/2001 |
| JP | 2003-157927 | 5/2003 |

* cited by examiner

*Primary Examiner*—Renee Luebke
*Assistant Examiner*—Larisa Tsukerman
(74) *Attorney, Agent, or Firm*—Gerald E. Hespos; Anthony J. Casella

(57) ABSTRACT

A board connector (1) has a housing (10) and terminal fittings (20) penetrate through the back wall (11) of the housing (10). A board connecting portion (21) of each terminal fitting (20) penetrates through the back wall (11) and is solder-connected to a board (2). The housing (10) has a heat transfer inhibiting portion for inhibiting heat transfer to the back wall (11). The heat transfer inhibiting portion has a through-hole (13) or heat-insulating grooves (17) in the back wall (11). As a result, heat transfer to the back wall (11) is inhibited and deformation of the back wall (11) due to thermal expansion also is inhibited. Consequently, it is possible to prevent the terminal fittings (20) from separating from the board (2) and going into a state of being not solder-connected thereto.

3 Claims, 10 Drawing Sheets

BOARD CONNECTOR

BACKGROUND OF THE INVENTION

1. Field of the Invention

The present invention relates to a board connector.

2. Description of the Related Art

As a common structure of a board connector, there has been heretofore known one described in Japanese Utility Model Laid-Open No. 61-60486. This board connector is provided with a hood portion capable of fitting with a counterpart connector and terminal fittings penetrate through the back wall of the hood portion. While one end of each terminal fitting protrudes into the hood portion, the other end thereof protrudes out of the hood portion, then bends toward the board side and is solder-connected to the board.

Solder used to connect the terminal fittings of a board connector contains lead considered harmful to the human body. Hence, lead-free solder in which no lead is used has come into use recently in response to environmental requirements. Since the melting point of this lead-free solder is higher than that of conventional solder, the lead-free solder needs to be subjected to reflow at even more elevated temperatures for an extended length of time.

However, in a conventional board connector, there have been cases in which terminal fittings separate from a board as the connector as a whole expands with heat during reflow, thereby going into a state of being not soldered to the board.

The present invention has been accomplished in view of the above-described problem. It is therefore an object of the present invention to prevent terminal fittings from separating from a board and going into a state of being not soldered thereto.

SUMMARY OF THE INVENTION

The present invention, which is means for achieving the above-described object, is a board connector provided with a connector housing and terminal fittings provided so as to penetrate through the back wall of the connector housing. One end of each of the terminal fittings is provided with a board connecting portion penetrating through the back wall, protruding out of the connector housing and then being solder-connected to a board, and the connector housing is provided with a heat transfer inhibiting portion for inhibiting heat transfer to the back wall. Accordingly, it is possible to prevent the back wall of the connector housing from becoming deformed due to thermal expansion at the time of reflowing the board connector. Consequently, it is possible to prevent the terminal fittings and the board from going into a state of being not solder-connected to each other.

At least some walls except the back wall, among the walls composing the connector housing, serve as heat-receiving walls and the heat transfer inhibiting portion is provided in a position to be able to inhibit heat transfer from the heat-receiving walls to the back wall. Accordingly, it is possible to reduce the amount of heat to be transferred from the heat-receiving walls to the back wall of the connector housing at the time of reflowing the board connector. Consequently, it is possible to prevent the back wall of the connector housing from becoming deformed due to thermal expansion. As a result, it is possible to even more reliably prevent the terminal fittings and the board from going into a state of being not solder-connected to each other.

The heat transfer inhibiting portion preferably is a through-hole provided between the top face and the back wall of the connector housing. Accordingly, it is possible to dramatically reduce the amount of heat to be transferred from the top face of the connector housing serving as a heat-receiving surface at the time of reflow to the back wall. As a result, it is possible to even more reliably prevent the terminal fittings and the board from going into a state of being not solder-connected to each other.

The heat transfer inhibiting portion may be heat-insulating grooves provided between the top face and the back wall of the connector housing. Accordingly, it is possible to dramatically reduce the amount of heat to be transferred from the top face of the connector housing serving as a heat-receiving surface at the time of reflow to the back wall. As a result, it is possible to even more reliably prevent the terminal fittings and the board from going into a state of being not solder-connected to each other. Furthermore, since each heat-insulating groove is formed in the back wall of the connector housing in a non-penetrating manner, it is possible to prevent a decrease in the strength of the connector housing as a whole, compared with a case in which a through-hole is provided in the back wall.

The heat-reflecting portion provided on the top face of the connector housing in a position near the back wall thereof and the heat-reflecting portion is made of ceramics, metal, or a coating material containing a powder of ceramics or metal.

Since the heat-reflecting portion is formed on the top face of the connector housing in a position near the back wall thereof, heat produced at the time of reflow is reflected by this heat-reflecting portion. Consequently, it is possible to dramatically reduce the amount of heat to be transferred from the top face to the back wall of the connector housing. As a result, it is possible to even more reliably prevent the terminal fittings and the board from going into a state of being not solder-connected to each other.

DETAILED DESCRIPTION OF THE PREFERRED EMBODIMENTS

A first embodiment of the present invention will be described with reference to FIGS. 1 to 4.

Figure 2:
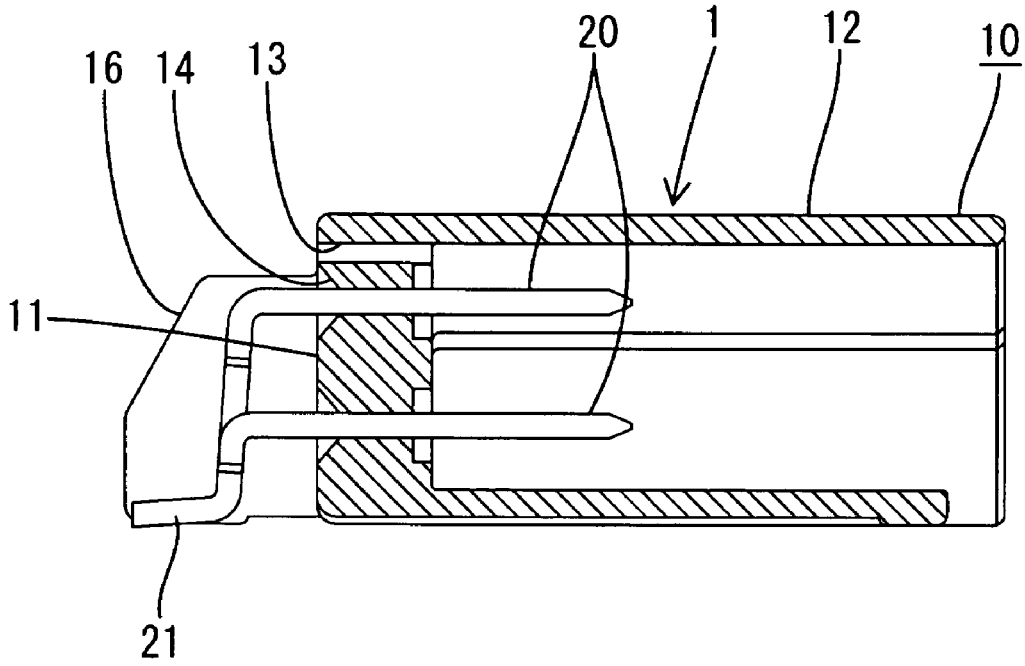
FIG. 2 is a cross-sectional view of the board connector in Embodiment 1.

A board connector 1 in the present embodiment is provided with a connector housing 10 and terminal fittings 20 provided so as to penetrate through the back wall 11 of the connector housing 10, as shown in FIG. 2. The connector housing 10 is provided with a hood portion 12 which is a portion with which a counterpart connector fits and a back wall 11 which is a portion integrally provided on the innermost side of the hood portion 12.

Figure 4:
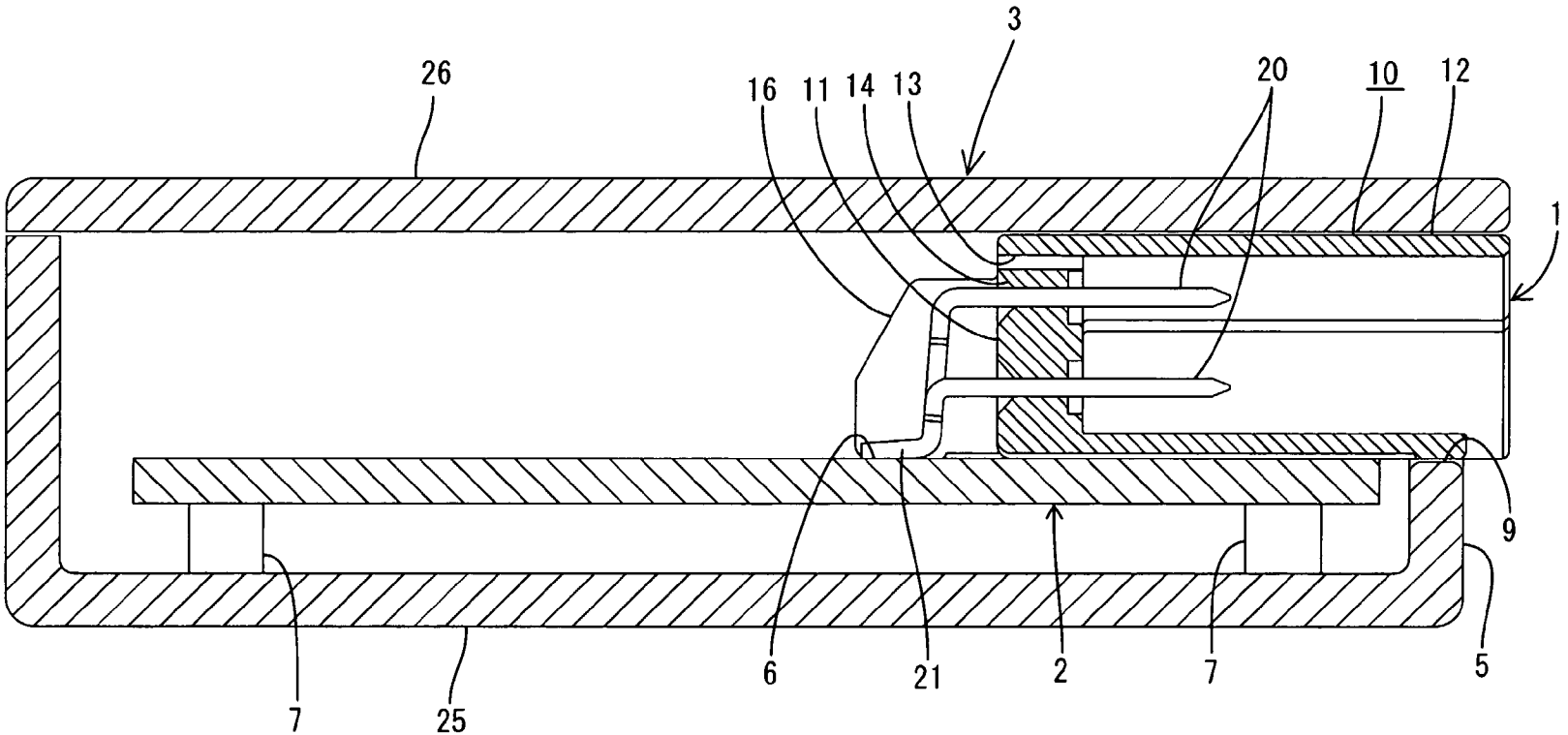
FIG. 4 is a cross-sectional view illustrating a state of the board connector in Embodiment 1 being mounted on a board and then loaded in a casing body.

As shown in FIG. 4, the board connector 1 is adapted to be soldered onto the surface of a board 2 by reflow and then assembled into a casing body 3.

In the present embodiment, an explanation will be made hereinafter with regard to the anteroposterior direction of the board connector 1, assuming that the right side (side with which a counterpart connector fits) as in FIG. 2 is the front of the board connector 1. Likewise, the upper side as in FIG. 2 is assumed to be the upside of the board connector 1, with regard to the vertical direction thereof.

Figure 1:
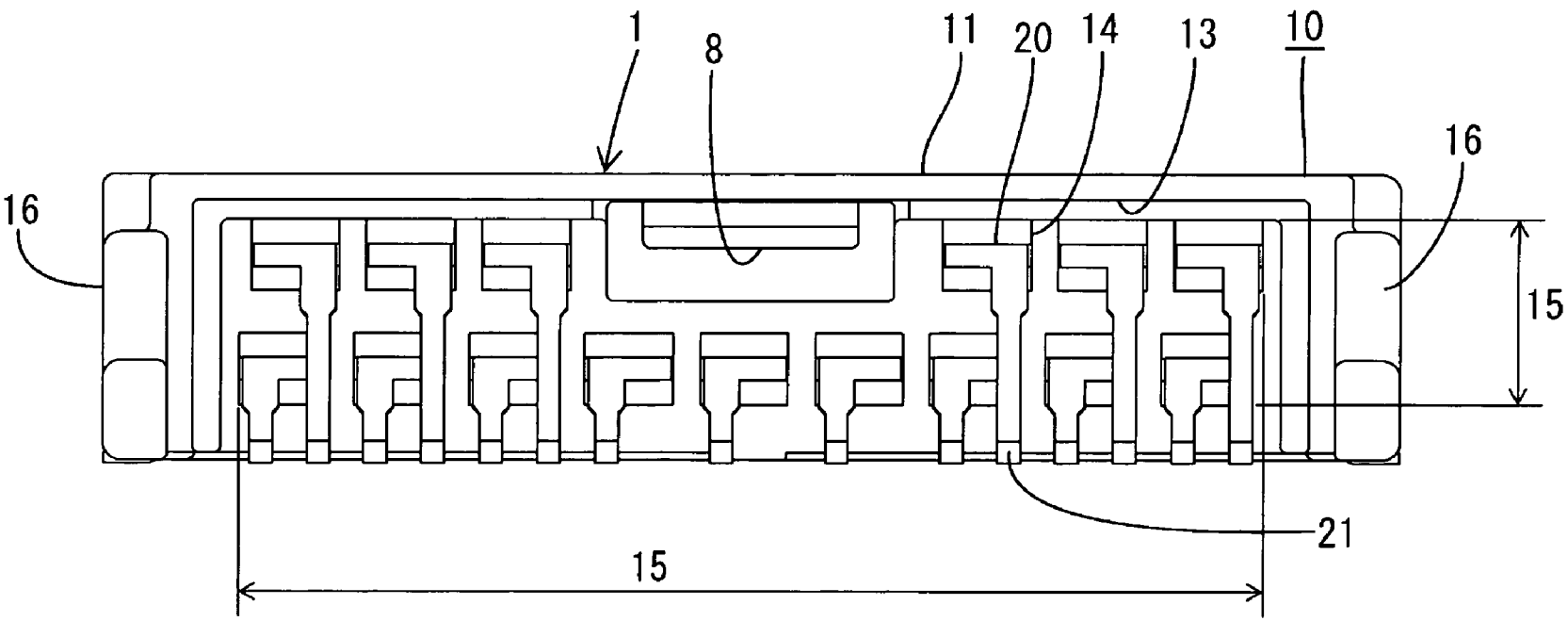
FIG. 1 is a rear view of a board connector in Embodiment 1.

The connector housing 10 is a component made of highly heat-resistant resin, such as liquid crystal polymer (LCP) or polyphenylene sulfide (PPS), and is formed into a shape like a horizontally long rectangular solid the cross section of which is approximately rectangular, as shown in FIG. 1 (drawing when the board connector 1 is viewed from the backside thereof). The upper and lower walls of the hood portion 12 are made thinner than the back wall 11 and thus the connector housing 10 is low-profile. On the back wall 11, there are disposed the terminal fittings 20 separately in upper and lower arrays by means of press fitting, insert molding, or the like, as shown in FIG. 4. Note that outer faces near the necks of the terminal fittings 20, among the outer faces of the back wall 11, serve as terminal lead-out portions 14 through which the terminal fittings 20 are led out.

In the present embodiment, an area surrounding a total of fifteen terminal lead-out portions 14, as shown in FIG. 1, is defined as a terminal group area 15. In the terminal lead-out portions 14, there are formed tapered lead-in portions, as shown in FIG. 2. On the left and right sides of the back wall 11 of the hood portion 12, there is formed a pair of protection walls 16 for protecting the terminal fittings 20 so as to protrude backwardly.

As shown in FIG. 1, six terminal fittings 20 are disposed on the upper side of the back wall 11 and nine terminal fittings 20 are disposed on the lower side thereof. Three each of the six terminal fittings 20 disposed on the upper side are arranged on the left and right sides, respectively, with a locking protrusion 8 positioned therebetween. These terminal fittings 20 are disposed at equal pitches in a horizontal direction. The upper-side and lower-side groups of 12 terminal fittings 20, except the three terminal fittings 20 positioned in the lower-middle section, are disposed in correspondence with each other's position.

As shown in FIG. 2, the terminal fittings 20 protrude from the terminal lead-out portions 14 toward the outside of the connector housing 10, and then bend downwardly (to the board 2 side). Upon reaching the surface of the board 2, the terminal fittings 20 once again bend backwardly. These second bend portions serve as board connecting portions 21 for connection with the board 2. Lands 6 on the board 2 and the board connecting portions 21 are solder-connected to each other.

As shown in FIG. 1, portions of each pair of upper-side and lower-side terminal fittings 20 in the rear of the terminal lead-out portions 14 thereof are displaced from each other in a horizontal direction. Consequently, the board connecting portions 21 horizontally align at equal pitches on the same line.

As shown in FIG. 4, the anterior end of the board connector 1 is in a state of slightly protruding from the anterior end of the board 2 when the board connector 1 is mounted on the board 2.

Figure 3:
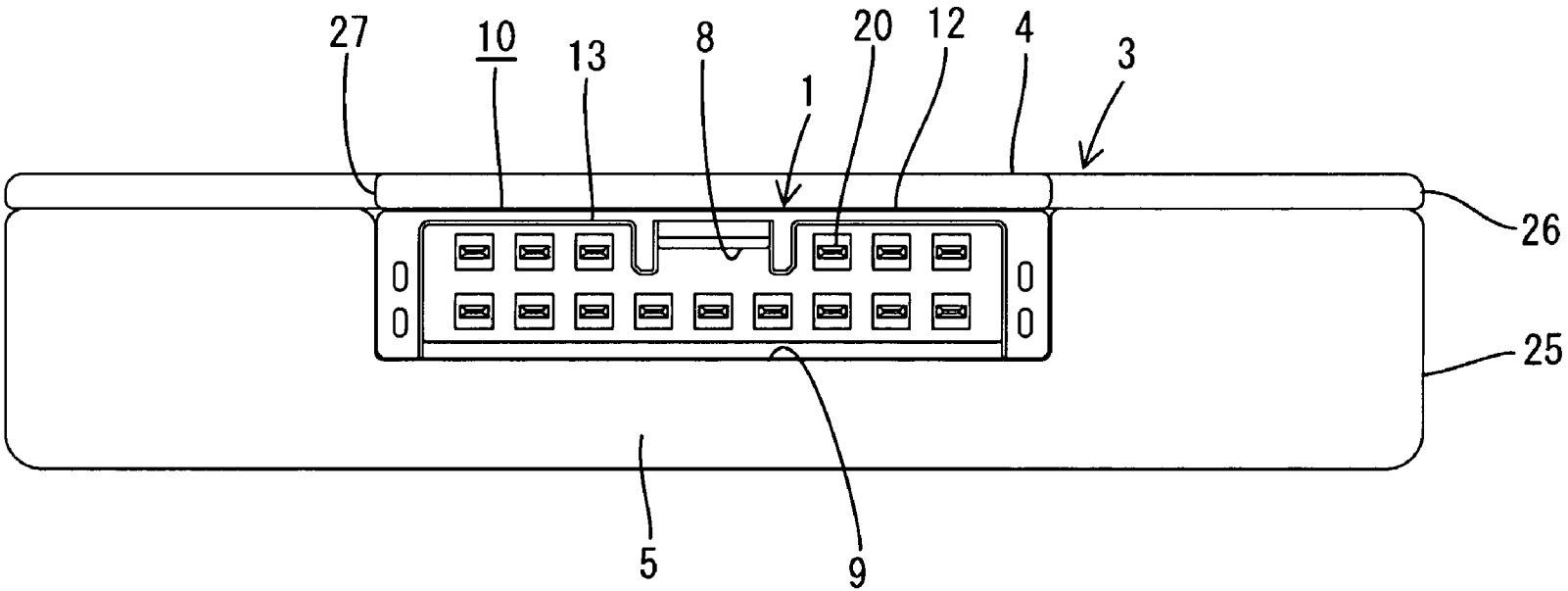
FIG. 3 is a front view illustrating a state of the board connector in Embodiment 1 being mounted on a board and then loaded in a casing body.

As shown in FIG. 3, the casing body 3 is formed of a main portion 25 the top face of which is openable and of a lid 26 attached so as to cover the top face of the main portion 25. The casing body 3 is adapted to be able to accommodate inside the board 2 and the board connector 1.

On the front face 5 of the main portion 25, there is formed an opening portion 9 cut out so as to fit the shape of the anterior end of the hood portion 12. The casing body 3 is configured so that when the board 2 is mounted inside the casing body 3, the hood portion 12 fits with the opening portion 9 with the anterior end of the hood portion 12 protruding from the opening portion 9.

As shown FIG. 4, mounting protrusion portions 7 for mounting the board 2 are protrusively provided on the internal bottom surface of the casing body 3. The board 2 is fixed to these mounting protrusion portions 7 with screws or the like.

As shown in FIG. 3, at the edge of the anterior end of the lid 26, there is provided a presser piece 27 across the entire width of the lid 26 corresponding to the opening portion 9 so as to protrude forward. The presser piece 27 abuts against the top face of the opening portion of the hood portion 12. It is thus possible to prevent the top face of the opening portion of the hood portion 12 from swelling upwardly and becoming deformed when fitting connectors with each other.

As shown in FIG. 4, the upper edge of the opening portion of the hood portion 12 is flush with the front edge of the presser piece 27. In addition, the lower edge of the opening portion of the hood portion 12 is flush with the lower edge of the opening portion 9 of the main portion 25. Consequently, even if a counterpart connector is not inserted straight into the hood portion 12, the hood portion 12 is prevented from becoming expansively deformed, thereby causing such a problem as the front edges of the terminal fittings 20 become bent.

In the back wall 11 of the connector housing 10, there is provided a through-hole 13 so as to surround the terminal group area 15 from the upside and the left and right sides thereof, as shown in FIG. 1. The through-hole 13 is cut through on three sides of the hood portion 12 (connector housing 10), except the bottom face side thereof. Accordingly, the through-hole 13 functions to inhibit heat transfer from the left and right sides and from the top face of the hood portion 12 (connector housing 10) to the back wall 11. The left and right sides and the top face of the hood portion 12 (connector housing 10) correspond to the "heat-receiving walls" of the present invention.

Hereinafter, an explanation will be made of the action of the board connector 1 configured as described above.

First, the board connector 1 is mounted on the board 2. At this time, each board connecting portion 21 provided at one end of each terminal fitting 20 is placed on each land 6 of the board 2. When the board 2 is made to travel within a reflow furnace in this condition, solder previously applied to the lands 6 of the board 2 melts. Then, the solder cools down and hardens, thereby electroconductively connecting the board connecting portions 21 and the lands 6 to each other.

When reflowing the board connector 1, the connector housing 10 receives heat mainly from above. Consequently, the top face, among other faces of the connector housing 10 (hood portion 12), becomes hot. If the top face of the connector housing 10 becomes hot, the back wall 11 also becomes hot and expands with heat due to heat transfer from the top face of the connector housing 10 to the back wall 11. If the back wall 11 becomes deformed due to thermal expansion, the board connecting portions 21 and the board 2 may go into a state of being not solder-connected to each other.

Hence, in the present embodiment, the through-hole 13 for inhibiting heat transfer is provided between the top face and the back wall 11 of the connector housing 10. This through-hole 13 corresponds to the "heat transfer inhibiting portion" of the present invention.

In the present embodiment, the through-hole 13 is highly effective in inhibiting heat transfer to the back wall 11, compared with a case in which the through-hole 13 is partially coupled with the back wall 11, since there is formed an air layer inside the through-hole 13.

In the present embodiment, since the through-hole 13 is provided so as to surround three sides of the connector housing 10 (hood portion 12) except the lower surface side thereof, as described above, it is possible to even more effectively inhibit or shut off heat transfer (if the through-hole 13 is provided only between the top face and the back wall 11 of the connector housing 10, heat may transfer to the back wall 11 through walls composing the left and right sides of the connector housing 10).

In addition, in the present embodiment, the board connector 1 can be used in an even higher-temperature environment since highly heat-resistant resin is used for the connector housing 10.

After the board connector 1 is mounted on the board 2, this board 2 is assembled into the casing body 3. The board 2 is fixed to the mounting protrusion portions 7 provided on the internal lower surface of the casing body 3 using screws or the like. When the board 2 is assembled, the presser piece 27 pressurizes the top face of opening portion of the hood portion 12. Consequently, it is possible to prevent the top face of the opening portion of the hood portion 12 from swelling and becoming deformed due to forcible insertion of a counterpart connector.

As heretofore described, in the present embodiment, heat transfer from walls (heat-receiving walls) composing the top face and the left and right sides of the connector housing 10 (hood portion 12) to the back wall 11 is inhibited since the through-hole 13 is provided so as to surround three sides of the terminal group area 15 (see FIG. 1). Consequently, it is possible to reduce the amount of deformation in the back wall 11 due to thermal expansion. Accordingly, it is possible to prevent the terminal lead-out portions 14 from being displaced away from the surface of the board 2. As a result, it is possible to prevent the board connecting portions 21 and the board 2 from going into a state of being not solder-connected to each other.

In addition, in the present embodiment, the connector housing 10 has been made low-profile as a result of the top and bottom faces of the hood portion 12 having been thin-walled.

In addition, although the strength of the hood portion 12 decreases as a result of the top and bottom faces of the hood portion 12 having been thin-walled, the hood portion 12 is still prevented from becoming deformed, thereby causing the terminal fittings 20 to break, even if a counterpart connector is not inserted straight into the hood portion 12. This is because the top and bottom faces of the hood portion 12 are pressurized by the lid 26 and the main portion 25 of the casing body 3.

It should be noted that the through-hole 13 is preferably provided between the top face and the back wall 11 of the connector housing 10. This is because the top face of the connector housing 10 is a heat-receiving wall most subject to heat radiation from a reflow furnace.

A second embodiment of the present invention will be described with reference to FIGS. 5 and 6.

A board connector 1 in accordance with the second embodiment is such that the structure of the board connector 1 in accordance with the first embodiment has been partially modified. Therefore, the same components as those of the first embodiment will not be explained again.

Figure 5:
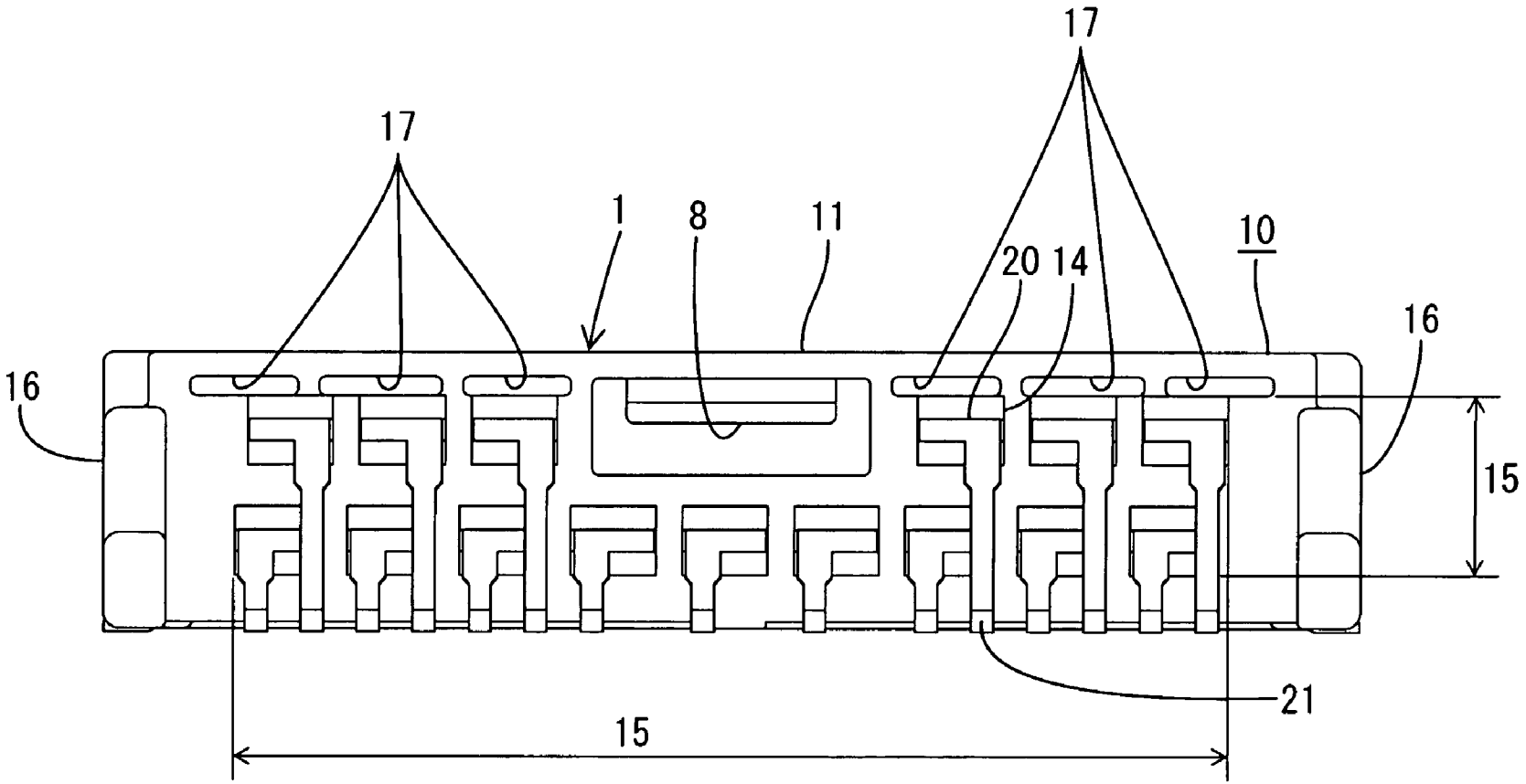
FIG. 5 is a rear view of a board connector in Embodiment 2.
Figure 6:
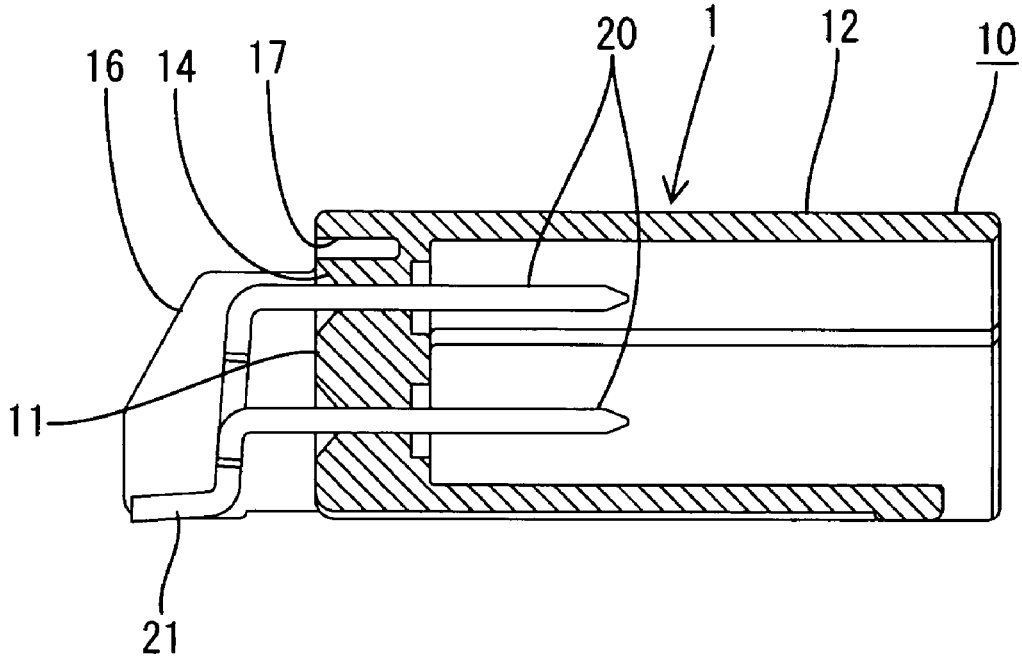
FIG. 6 is a cross-sectional view of the board connector in Embodiment 2.

In the second embodiment, a total of six heat-insulating grooves 17 are provided in place of the through-hole 13 in the first embodiment across the entire width corresponding to upper terminal lead-out portions 14 (see FIG. 5). Each heat-insulating grooves 17 is provided in a non-penetrating manner with part of a back wall 11 left over between the front face thereof and the heat-insulating groove 17 (see FIG. 6).

According to the present embodiment, it is possible to increase the strength of the back wall 11 while inhibiting heat transfer from the hood portion 12 to the back wall 11 since the back wall 11 and the hood portion 12 are coupled with each other along the entire circumference thereof.

It should be noted that, as in Embodiment 1, the heat-insulating grooves 17 are preferably provided between the top face and the back wall 11 of the connector housing 10. This is because the top face of the connector housing 10 is a heat-receiving wall most subject to heat radiation from a reflow furnace.

A third embodiment of the present invention will be described with reference to FIGS. 7 and 8.

A board connector 1 in accordance with the third embodiment is such that the structure of the board connector 1 in accordance with the first embodiment has been partially modified. Therefore, the same components as those of the first embodiment will not be explained again.

Figure 7:
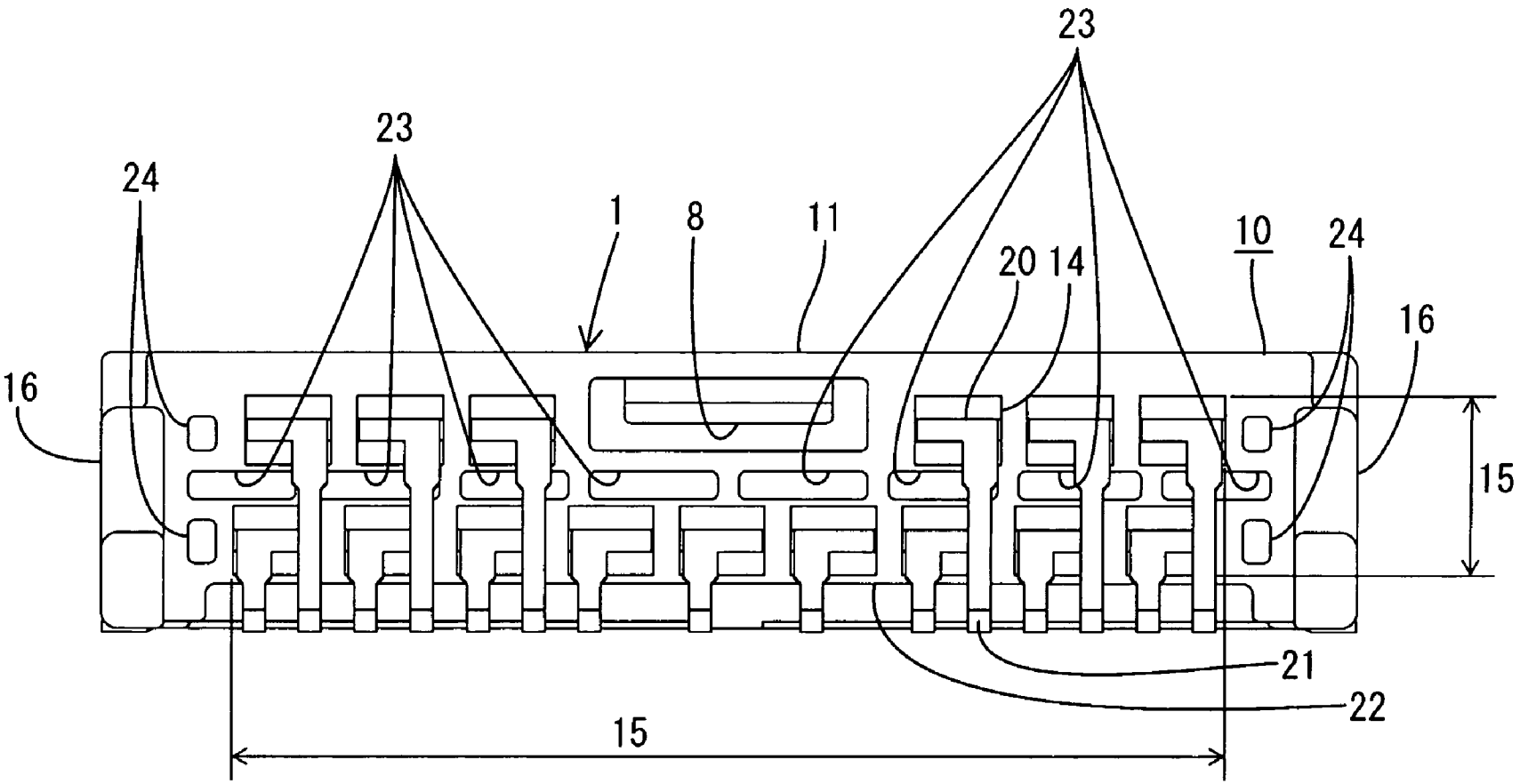
FIG. 7 is a rear view of a board connector in Embodiment 3.
Figure 8:
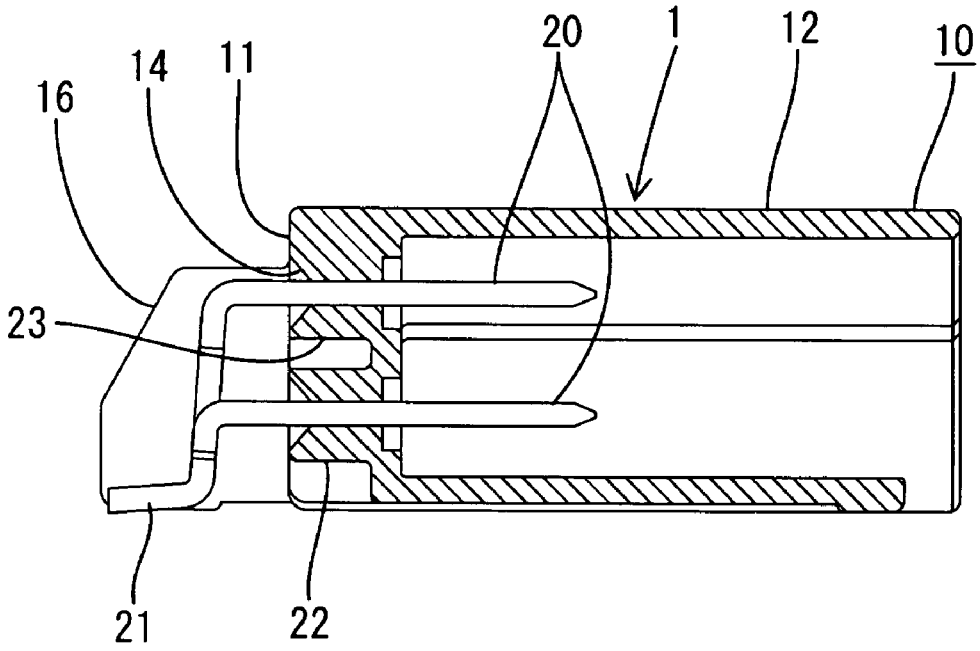
FIG. 8 is a cross-sectional view of the board connector in Embodiment 3.

In the present embodiment, a lowermost thin-walled portion 22, middle thin-walled portions 23 and side thin-walled portions 24 are provided in a back wall 11, as shown in FIGS. 7 and 8. The lowermost thin-walled portion 22 is a non-penetrating groove provided uninterruptedly in a horizontal direction on the lower side of a terminal group area 15. The middle thin-walled portions 23 are non-penetrating grooves, eight in number, intermittently provided in a horizontal direction between upper and lower terminal fittings 20. The side thin-walled portions 24 are non-penetrating grooves, four in number, provided on the left and right sides of each of the upper-side and lower-side groups of terminal fittings 20.

According to the present embodiment, it is possible to absorb deformation resulting from thermal expansion in the back wall 11 by the thin-walled portions 22, 23 and 24, since the thin-walled portions 22, 23 and 24 are provided between the terminal fittings 20 and the board 2. Accordingly, it is possible to prevent the terminal fittings 20 from being displaced away from the surface of the board 2.

The fourth embodiment of the present invention will be described with reference to FIG. 9.

A board connector 1 in accordance with fourth embodiment is such that the structure of the board connector 1 in accordance with the first embodiment has been partially modified. Therefore, the same components as those of the first embodiment will not be explained again.

Figure 9:
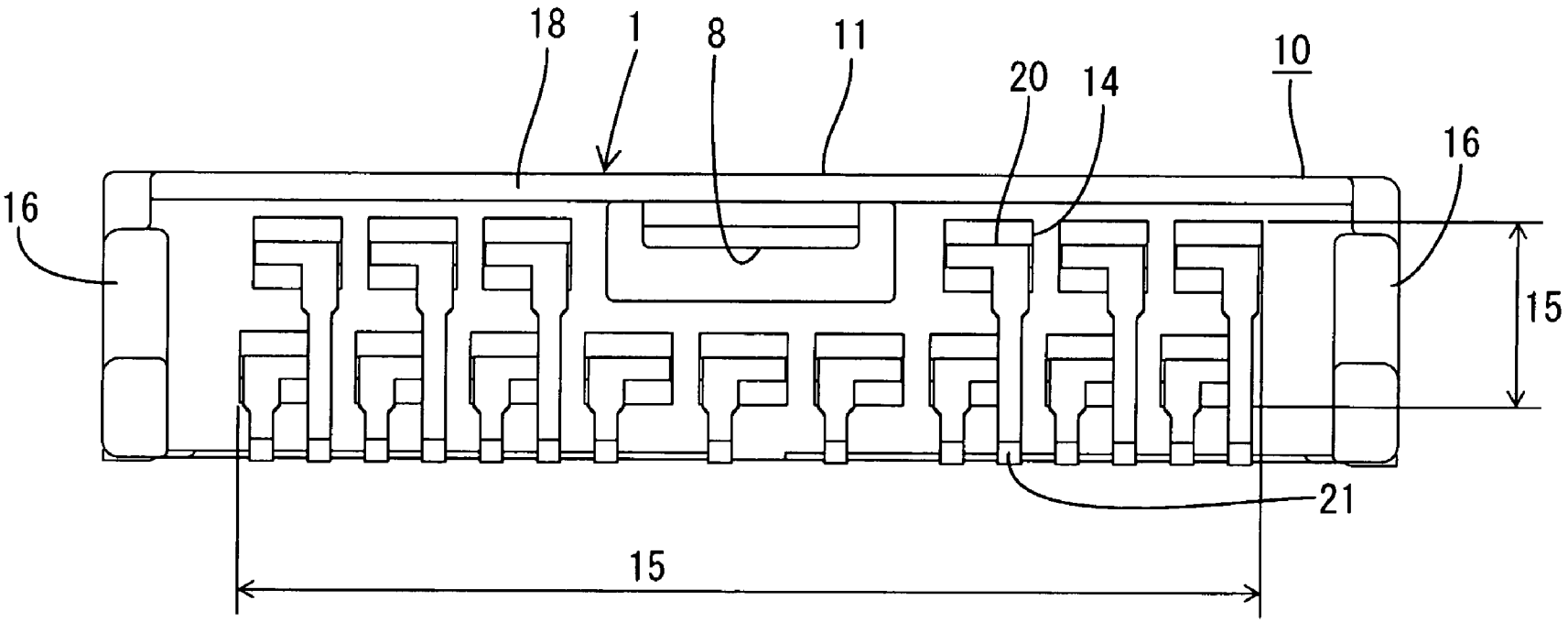
FIG. 9 is a rear view of a board connector in Embodiment 4.

In a board connector 1 in accordance with the fourth embodiment, a heat-reflecting portion 18 is formed on the top face of the connector housing 10, as shown in FIG. 9. This heat-reflecting portion 18 is made of ceramics, metal, a coating material containing a powder of ceramics or metal, or the like. The heat-reflecting portion 18 is formed on the top face of the hood portion 12 of the connector housing 10 in a position near a back wall 11. The heat-reflecting portion 18 is formed to be integral with the connector housing 10.

According to the present embodiment, heat from a reflow furnace is received by the top face of the hood portion 12 but can be reflected by the heat-reflecting portion 18. Consequently, it is possible to reduce the amount of heat itself received by the top face of the hood portion 12. In addition, it is possible to even more effectively prevent heat transfer to the back wall 11 since the heat-reflecting portion 18 is formed near the back wall 11.

The present invention is not limited to the embodiments explained in the foregoing descriptions and with reference to the accompanying drawings. For example, the embodiments described below are also included in the technical scope of the present invention. Furthermore, the present invention may be modified and carried out in various other ways, in addition to the below-described embodiments, without departing from the subject matter of the present invention.

Figure 10:
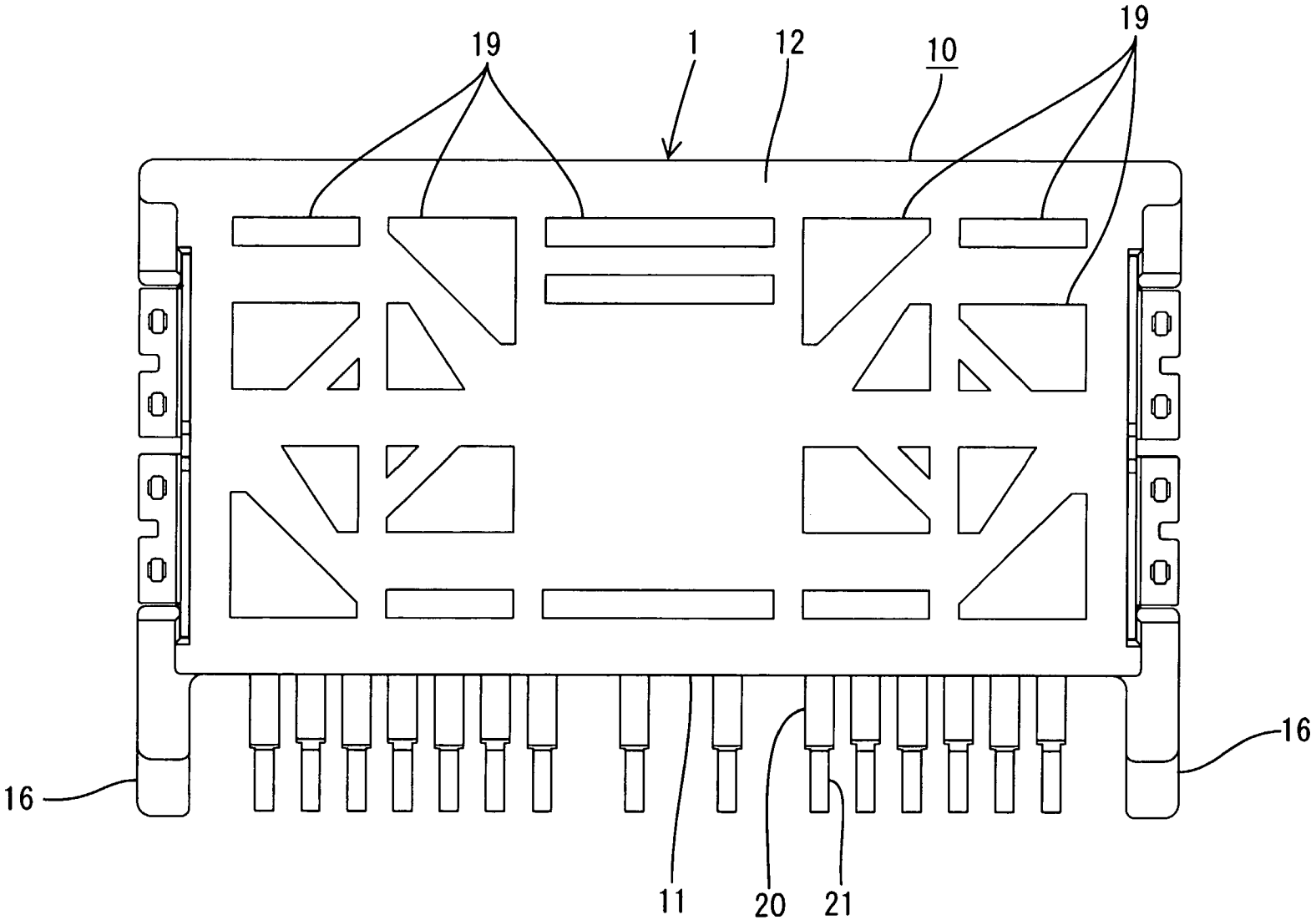
FIG. 10 is a plan view illustrating a board connector that uses a connector housing in which resin orientation has been deconcentrated.

(1) The resin used for the connector housing described in the foregoing embodiments does not expand evenly in every direction when heated and, therefore, is susceptible to thermal strain. Consequently, the terminal fittings and the board may separate from each other not only due to deformation caused by the thermal expansion of the back wall but also due to the thermal deformation of the connector housing itself, thus going into a state of being not solder-connected to each other. Hence, concavo-convex portions 19 formed of various shapes, including a triangle, a quadrangle, or a combination thereof, may be provided in the top face of the connector housing 10, as shown in FIG. 10, in order to minimize the possibility of causing strain in the connector housing. As a result, strain is less liable to occur in the connector housing 10 since a turbulent flow arises in a resin melted during heating.

(2) While in Embodiment 2, an example has been shown wherein the heat-insulating grooves are shaped so as to be open on the posterior surface side of the back wall, the heat-insulating grooves may be shaped so as to be open on the anterior surface side of the back wall, as long as the grooves are of non-penetrating type. Alternatively, it is acceptable to combine with each other a shape in which the grooves are open on the posterior surface side of the back wall and a shape in which the grooves are open on the anterior surface side of the back wall.

(3) While in Embodiments 1 to 4, it is assumed that the board connector receives heat from a reflow furnace, a heat source is not limited to reflow furnaces. The board connector may be heated by other means rather than a reflow furnace as long as the board connector can be placed under a high-temperature environment after being mounted on the board.

INDUSTRIAL APPLICABILITY

The present invention pertains to the manufacturing technique of a board connector to be mounted on a board and, therefore, has industrial applicability.

The invention claimed is:

1. A board connector for use with a board, the board connector comprising:

a connector housing configured to be disposed on the board, the connector housing including a back wall having a through-hole; and a terminal fittings disposed through the back wall of said connector housing, said terminal fitting having a board connecting portion at an end thereof, wherein:

the through-hole is cut through on three sides of said connector housing, except a bottom face side thereof; and the board connecting portion is solder-connected to the board.

2. The board connector according to claim 1, further comprising a heat-reflecting portion provided on the top face of said connector housing in a position near said back wall thereof and said heat-reflecting portion is made of ceramics, metal, or a coating material containing a powder of ceramics or metal.

3. A board connector for use with a board, the board connector comprising:

a connector housing having opposite front and rear ends, a back wall in proximity to the rear end and a hood projecting forward from the back wall to the front end, a bottom face configured for opposing the board and a top face opposite the bottom face, opposite left and right sides extending from the bottom face to the top face; and terminal fittings penetrating through the back wall of the connector housing, each of the terminal fittings having a front part projecting into the hood and a rear part projecting rearward of the back wall, portions of the respective terminal fittings rearward of the back wall being bent for connection to the board when the bottom face is opposed to the board, wherein:

the connector housing has at least one through hole formed through the back wall, the through hole having a first portion between the terminal fittings and the top face of the connector housing, a second portion between the terminal fittings and the left side of the connector housing and a third portion between the terminal fittings and the right side of the connector housing, wherein the through hole inhibits heat transfer between the top face of the connector housing and the back wall thereof.

* * * * *